US008561360B2

(12) United States Patent
Corbin, Jr.

(10) Patent No.: US 8,561,360 B2
(45) Date of Patent: Oct. 22, 2013

(54) SOUND ARRESTING BARRIER

(76) Inventor: Maxwell H. Corbin, Jr., Milford Center, OH (US)

( * ) Notice: Subject to any disclaimer, the term of this patent is extended or adjusted under 35 U.S.C. 154(b) by 16 days.

(21) Appl. No.: 13/554,414

(22) Filed: Jul. 20, 2012

(65) Prior Publication Data

US 2013/0025217 A1 Jan. 31, 2013

Related U.S. Application Data

(60) Provisional application No. 61/511,777, filed on Jul. 26, 2011.

(51) Int. Cl.
*E04B 1/82* (2006.01)

(52) U.S. Cl.
USPC ..... 52/144; 52/481.1; 52/774; 52/253; 52/300; 256/24; 256/65.06; 256/65.08; 256/DIG. 5

(58) Field of Classification Search
USPC ..... 52/220.1, 239, 243, 300, 210, 144, 241, 52/481.1, 774, 293, 295, 296; 181/290; 256/24, 65.03, 65.06, 65.08, DIG. 5
See application file for complete search history.

(56) References Cited

U.S. PATENT DOCUMENTS

| | | | | | |
|---|---|---|---|---|---|
| 1,669,382 | A * | 5/1928 | Smiley, Jr. | 52/282.5 |
| 4,074,489 | A * | 2/1978 | Eckel | 52/272 |
| 5,069,263 | A * | 12/1991 | Edwards | 160/135 |
| 5,092,100 | A * | 3/1992 | Lambert et al. | 52/774 |
| 5,702,090 | A * | 12/1997 | Edgman | 256/19 |
| 5,984,044 | A * | 11/1999 | Christensen | 181/210 |
| 6,079,173 | A * | 6/2000 | Waalkes et al. | 52/239 |
| 6,202,381 | B1 * | 3/2001 | Dame et al. | 52/745.1 |
| 6,820,388 | B2 * | 11/2004 | Newhouse et al. | 52/223.7 |
| 7,100,342 | B2 * | 9/2006 | Holloway | 52/782.1 |
| 7,395,999 | B2 * | 7/2008 | Walpole | 249/33 |
| 7,513,082 | B2 * | 4/2009 | Johnson | 52/144 |
| 2003/0006090 | A1 | 1/2003 | Reed | |
| 2004/0177573 | A1 * | 9/2004 | Newhouse et al. | 52/239 |
| 2005/0178613 | A1 | 8/2005 | Humphries et al. | |
| 2005/0188626 | A1 * | 9/2005 | Johnson | 52/144 |
| 2007/0131480 | A1 * | 6/2007 | Corbin et al. | 181/210 |
| 2007/0209305 | A1 * | 9/2007 | Douglas | 52/300 |
| 2008/0209827 | A1 * | 9/2008 | Webb | 52/220.7 |
| 2009/0194365 | A1 * | 8/2009 | Johnson | 181/290 |
| 2010/0078260 | A1 | 4/2010 | McNeal, Jr. | |
| 2010/0126797 | A1 | 5/2010 | Humphries et al. | |
| 2010/0243369 | A1 | 9/2010 | Fussiek et al. | |
| 2013/0009121 | A1 * | 1/2013 | Xu | 256/24 |

* cited by examiner

*Primary Examiner* — William Gilbert
*Assistant Examiner* — Alp Akbasli
(74) *Attorney, Agent, or Firm* — Wood, Herron & Evans, LLP

(57) ABSTRACT

A sound barrier wall suitable for new installations and for retrofitting existing sound barrier walls includes a plurality of vertically extending posts and a plurality of wall sections disposed between pairs of the posts. The posts may have generally I-shaped cross sections with oppositely disposed channels defined by flanges on opposite sides of the posts. The sound barrier may further include post covers coupled with the respective posts. The post covers may have lip portions that are received over the flanges of the posts. The wall sections are received within the respective channels and may contact at least one of the lip portions of the post covers.

9 Claims, 7 Drawing Sheets

SOUND ARRESTING BARRIER

CROSS-REFERENCE TO RELATED APPLICATIONS

This application claims the filing benefit of co-pending U.S. Provisional Patent Application No. 61/511,777, filed Jul. 26, 2011, the disclosure of which is incorporated by reference herein in its entirety.

TECHNICAL FIELD

The present invention relates generally to acoustic structures, and more particularly to a sound barrier for eliminating or reducing noise emanating from roadways, railways, airports, or other noise generating areas.

BACKGROUND

Sound barrier walls are known in the art and have been utilized to eliminate or reduce noise emanating from roadways, railways, airports, or other such areas adjacent residential and/or business communities. These sound barriers are typically constructed in the form of elongate wall structures interposed between a noise source and an area that is desired to be protected from the noise. Conventional sound barriers have been constructed using I-beam shaped posts and concrete wall sections interposed between the posts. These conventional sound barrier walls are heavy and difficult to install. In addition, when it is desired to repair or replace sections of such conventional sound barrier walls, the heavy concrete wall sections make it difficult to remove and replace. The construction of such conventional sound barrier walls makes it difficult to retrofit existing sound walls if there are imperfections in the construction materials used to make the sound wall.

SUMMARY

The present invention overcomes the foregoing and other shortcomings and drawbacks of conventional sound arresting barriers heretofore known. While the invention will be described in connection with certain embodiments, it will be understood that the invention is not limited to these embodiments. On the contrary, the invention includes all alternatives, modifications and equivalents as may be included within the spirit and scope of the present invention.

Other objects, features and advantages of the present invention will be readily understood after reading the following detailed description together with the accompanying drawings.

DETAILED DESCRIPTION

Figure 1:
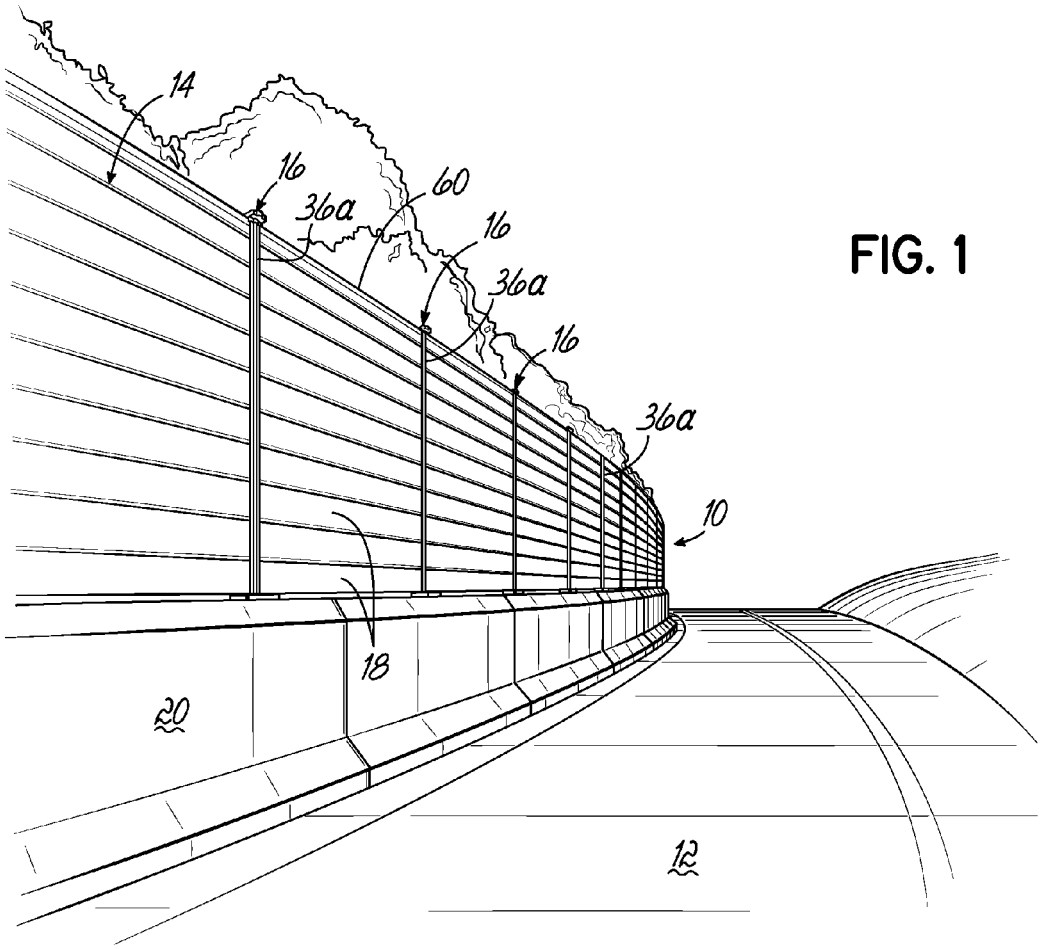
FIG. 1 is a perspective view of an exemplary sound barrier installed along a roadway, in accordance with the principles of the present invention.

FIG. 1 depicts an exemplary sound barrier 10 according to the present invention and utilized along a roadway 12 to eliminate or reduce noise transmitted from the roadway 12 to the adjacent area on the opposite side of the sound barrier 10. The sound barrier 10 comprises a series of elongate wall sections 14 disposed between generally vertically extending posts 16. In this embodiment, the wall sections 14 comprise a plurality of sound arresting members 18 arranged end-to-end and stacked in a vertical direction, one atop another, to create a wall or partition between the noise generating area and the area to be protected. The sound arresting members 18 are supported at their respective ends by the spaced apart posts 16, which have been arranged along the boundary between the noise source and the protected area. In FIG. 1, the sound barrier 10 is constructed along the side of the roadway 12 and is positioned atop a parapet or retaining wall 20. It will be recognized however that the sound barrier 10 may alternatively be erected directly upon the ground surface.

Figure 2:
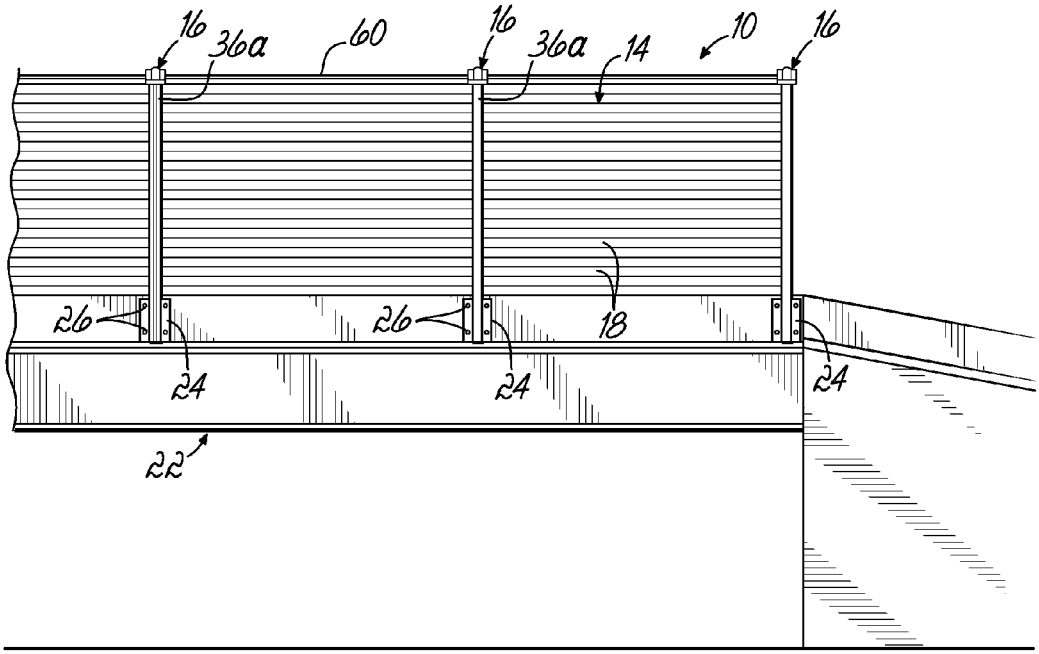
FIG. 2 is an elevation view of an exemplary sound barrier utilized along a bridge overpass, in accordance with the principles of the present invention.

FIG. 2 depicts another embodiment of a sound barrier 10 according to the present invention. In this embodiment, the sound barrier 10 is erected along the edge of a bridge overpass 22. The posts 16 are secured to the bridge structure, such as by brackets 24 fastened directly to the bridge structure by bolts 26. FIGS. 1 and 2 depict only two possible configurations of a sound barrier 10 according to the present invention. It will be recognized that various other embodiments are possible, for example, for use along railways, at the boundary of airport runways, and surrounding industrial areas.

A sound barrier 10 in accordance with the principles of the present invention is suitable not only for new installations, but may also be used to retrofit existing sound walls, for example, when it is desired to repair or replace portions of an existing sound wall or an entire sound wall all together. In the exemplary embodiment shown in FIGS. 3-5, the sound barrier 10 comprises a plurality of generally vertically extending posts 16 spaced apart along the boundary of an area where it is desired to locate the sound barrier 10. Each post 16 has a generally I-shaped cross-section defined by a central structural web 30 and having spaced apart pairs of flanges 32*a*, 32*b*, 32*c*, 32*d* extending generally perpendicular to the central web 30 to define first and second oppositely disposed channels 34*a*, 34*b* along the vertical lengths of the posts 16. At least one elongate post cover 36*a* is coupled to at least one side of each post 16. In the embodiment shown, a first post cover 36*a* is coupled to one side of the post 16, and a second post cover 36*b* is coupled to the opposite side of the post 16. Each of the post covers 36*a*, 36*b* comprises a central wall portion 38 and first and second lip portions 40, 42 disposed on opposite ends of the central wall portion 38. The post cover 36*a*, 36*b* is configured so that each lip portion 40, 42 of the post cover 36*a*, 36*b* may be received over a corresponding flange 32*a*, 32*b*, 32*c*, 32*d* of a post 16, whereby the post cover 36*a*, 36*b* is retained on the post 16 by the respective lip portions 40, 42. The sound barrier 10 further comprises one or more wall sections 14 received in one of the channels 34*a*, 34*b* of a post 16. An opposite end of the wall section 14 is received in the channel of a corresponding post 16, such that the one or more wall sections 14 are retained within the corresponding channels of adjacent posts 16.

The sound barrier 10 may further comprise a post cap 50 received on an upper, free end 52 of at least one of the plurality of posts 16. In the embodiment shown, the post cover 50 has an open end 54 that receives the free end 52 of the post 16, with the post 16 extending through the open end 54 upwardly into the post cap 50. In the embodiment shown, the post cap 50 is configured to be fitted over the free end 52 of a post 16 such that at least one of the post covers 36*a*, 36*b* is received within the open end 54 of the post cap 50. The sound barrier 10 may further comprise a wall top cap 60 received on an upper, free end 62 of at least one of the wall sections 14. In the embodiment shown, length of the wall top cap 60 is selected to extend between adjacent posts 16, with the distal ends 64 of the wall top cap 60 abutting the respective post caps 50. It will be appreciated that various other configurations of the wall top cap 60 relative to the post cap 50 are possible. As a non-limiting example, post cap 50 may be configured so that wall top cap 60 can be received under the post cap 50.

Any of the components of the sound barrier 10 shown and described herein may be formed from glass-reinforced polymeric material, commonly referred to as fiberglass. In an exemplary embodiment, each of the post cover 36*a*, 36*b*, post cap 50, wall top cap 60, and wall sections 14 may be formed from glass-reinforced polymeric material. Such a construction facilitates ready modification and custom fitting of the components, such as by cutting and trimming, at an installation site.

Figure 3:
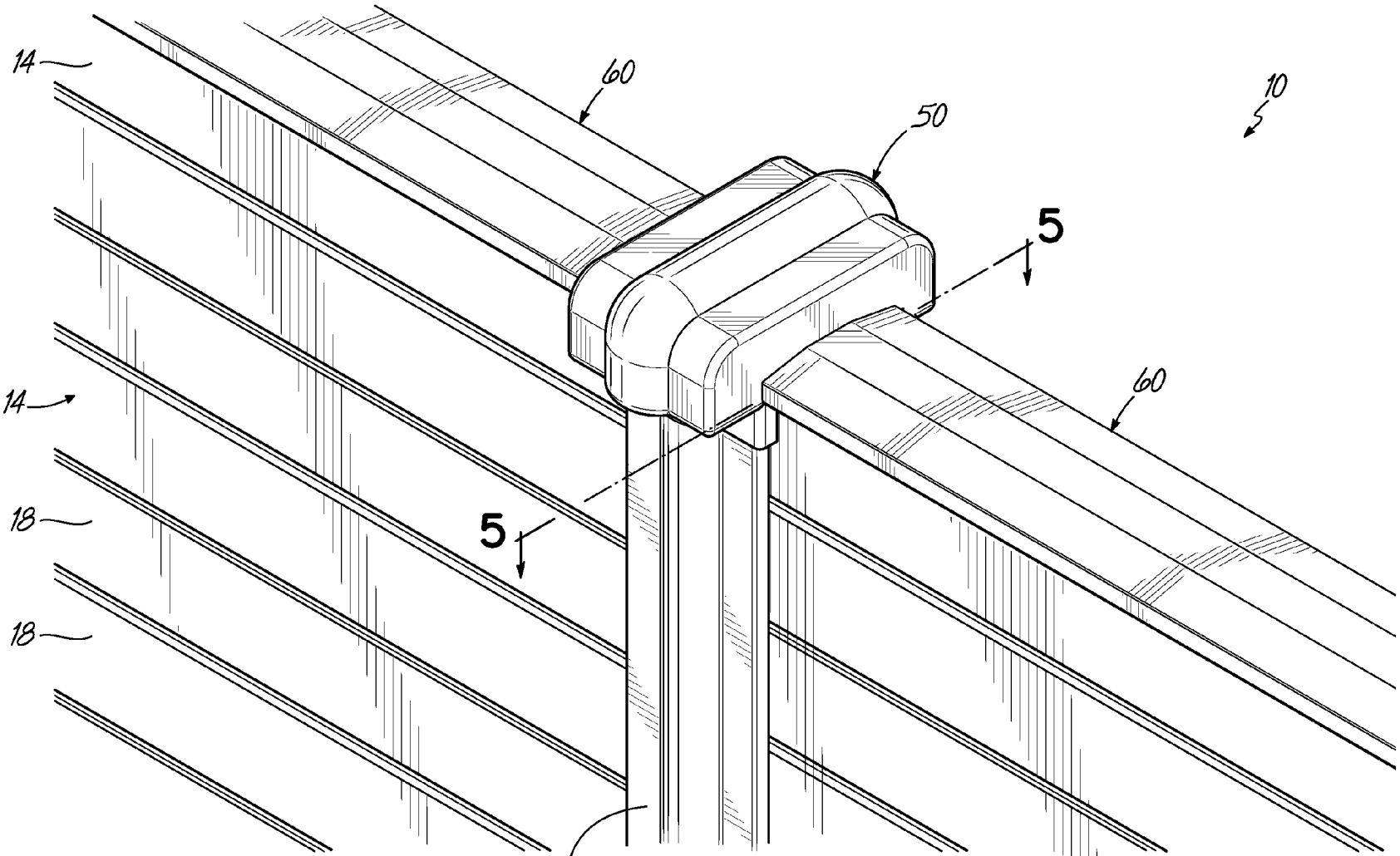
FIG. 3 is an enlarged perspective view of a portion of the sound barrier of FIG. 2.
Figure 4:
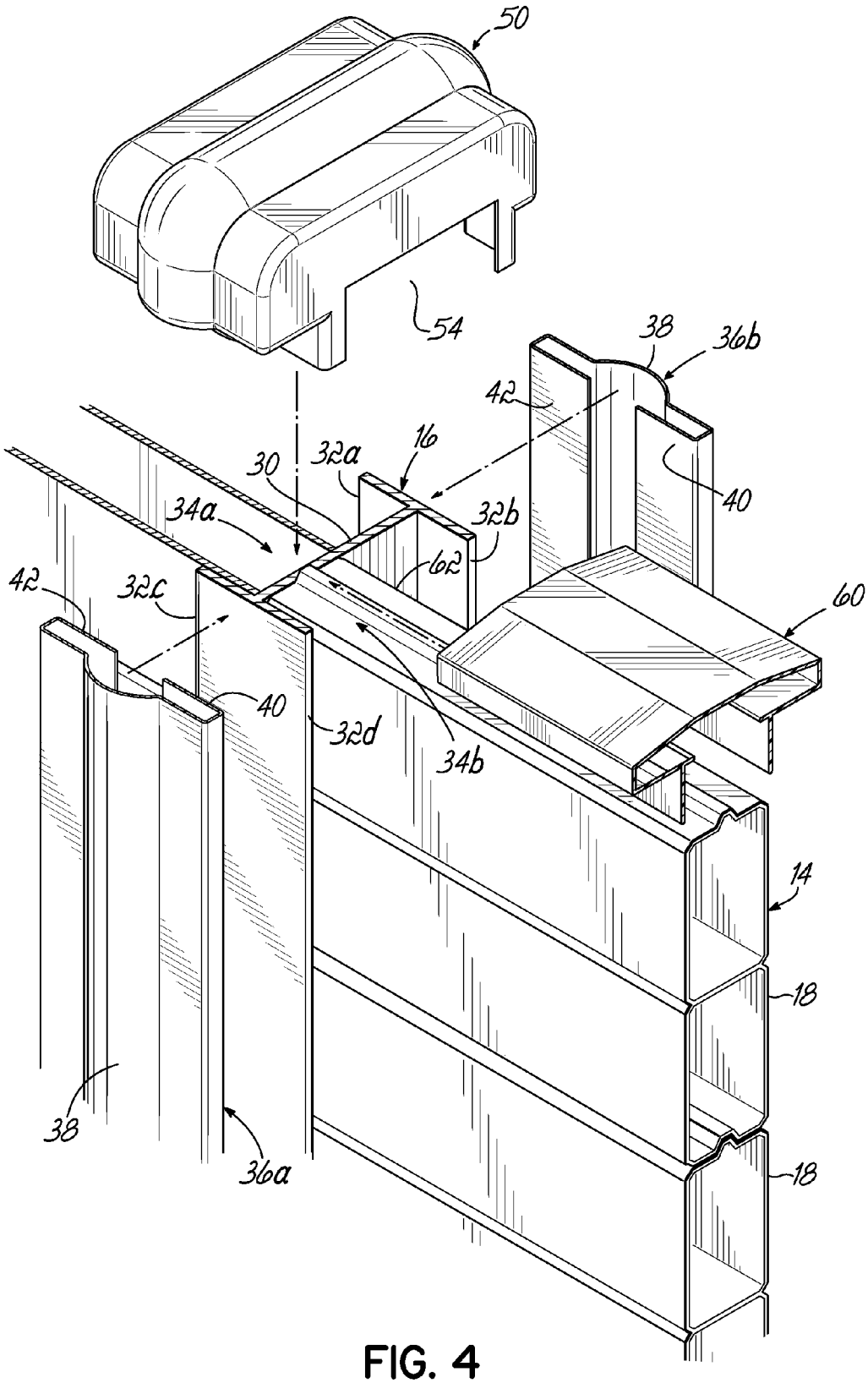
FIG. 4 is an exploded perspective view of the sound barrier of FIG. 3.
Figure 5:
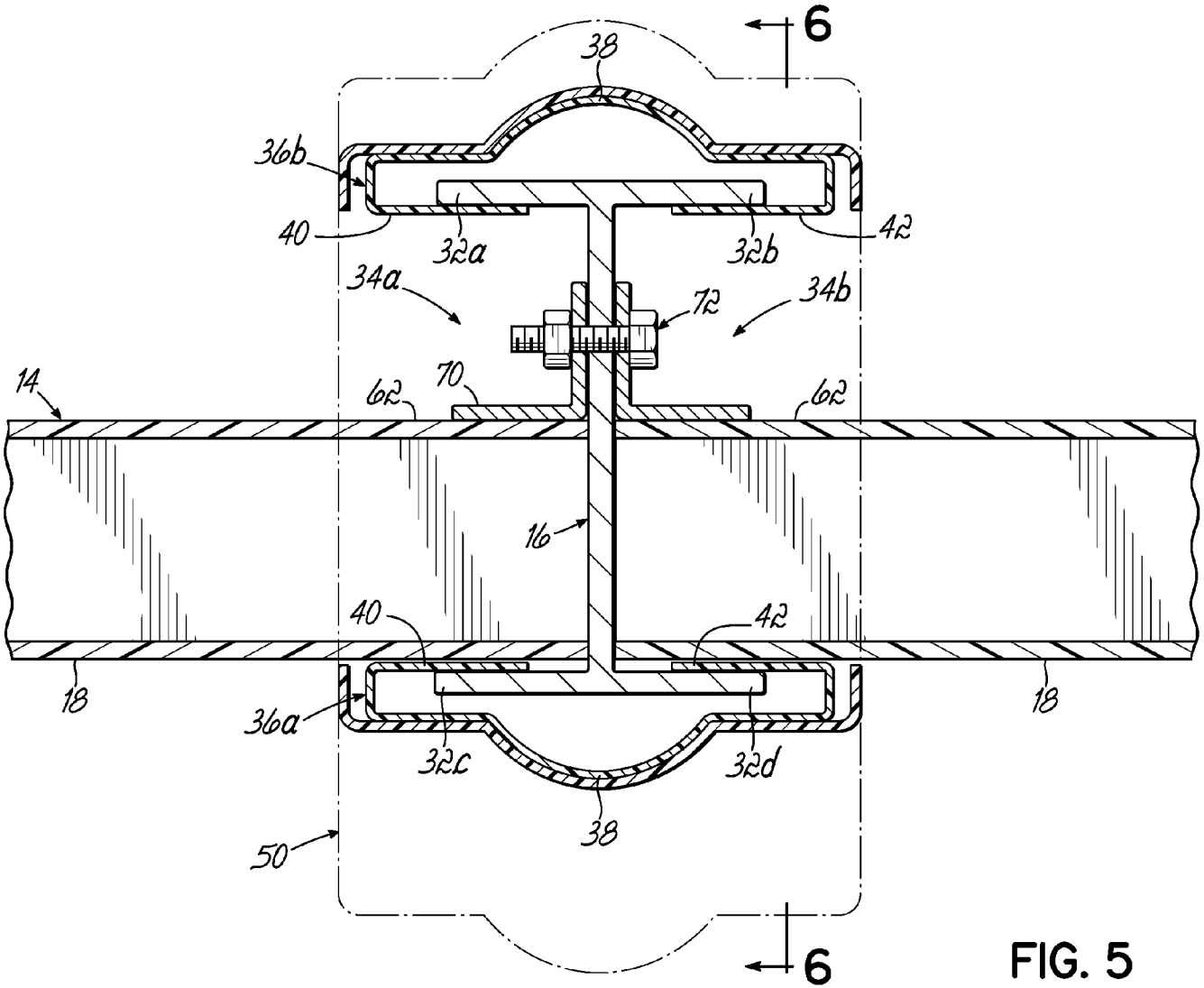
FIG. 5 is a partial cross-sectional view taken along line 5-5 in FIG. 3.
Figure 6:
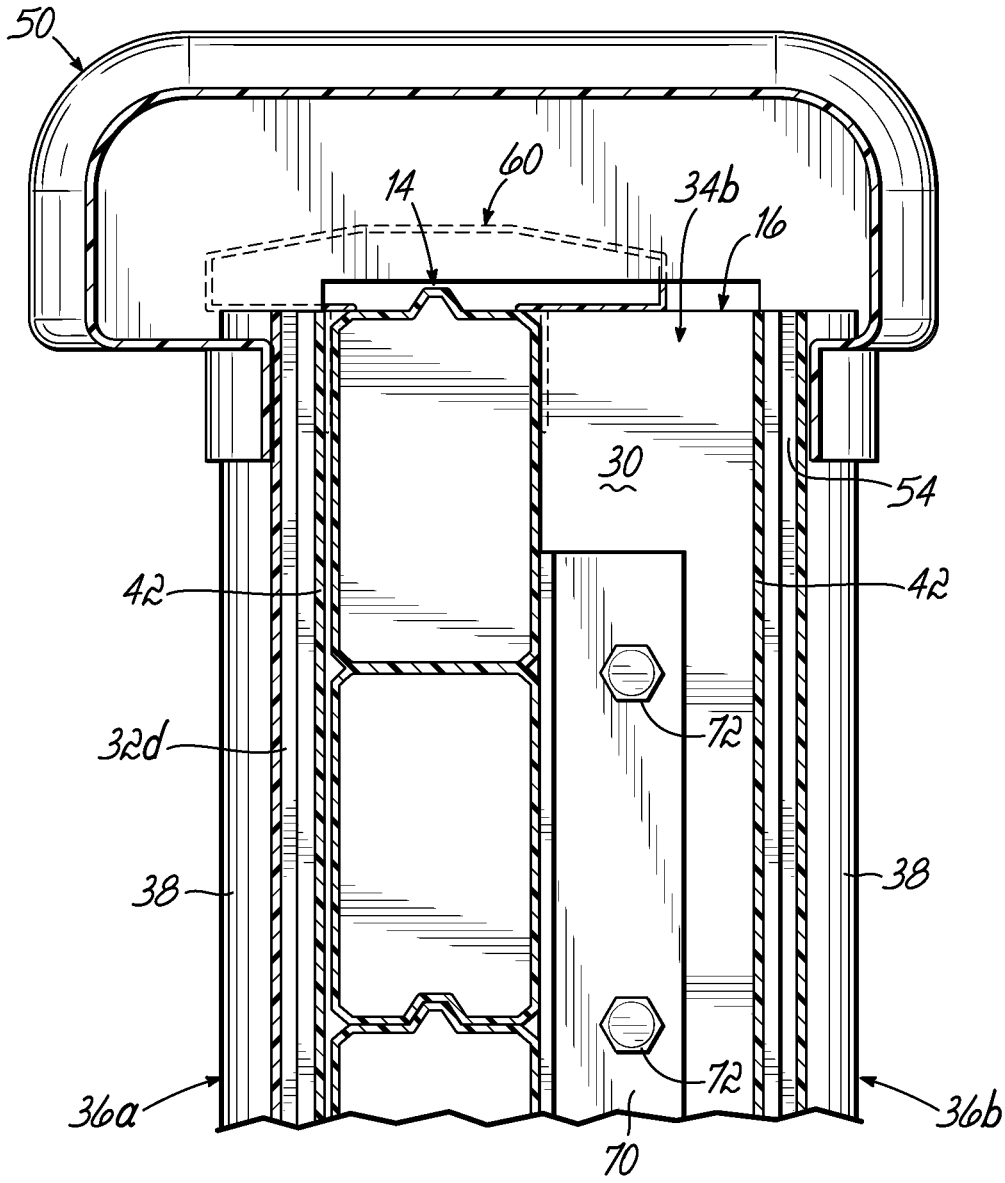
FIG. 6 is a partial cross-sectional view taken along line 6-6 in FIG. 5.

With continued reference to FIGS. 3 and 4, and referring further to FIGS. 5 and 6, it is seen that the depth of wall sections 14 may not extend the entire span between flanges 32*a*, 32*b*, 32*c*, 32*d* of the channels 34*a*, 34*b*. To secure wall sections 14 within the channels 34*a*, 34*b* of such an embodiment, the sound barrier 10 may further include brackets 70 disposed within the channels 34*a*, 34*b* and engaging the distal ends of the wall sections 14. In the embodiment shown, brackets 70 have generally L-shaped cross-sections and are secured to the posts 16 by fasteners 72. It will be appreciated, however, that various other methods or structure may alternatively be used to secure wall sections 14 within channels 34*a*, 34*b* when the depths of the wall sections 14 do not span the entire space between flanges 32*a*, 32*b*, 32*c*, 32*d*.

Figure 5A:
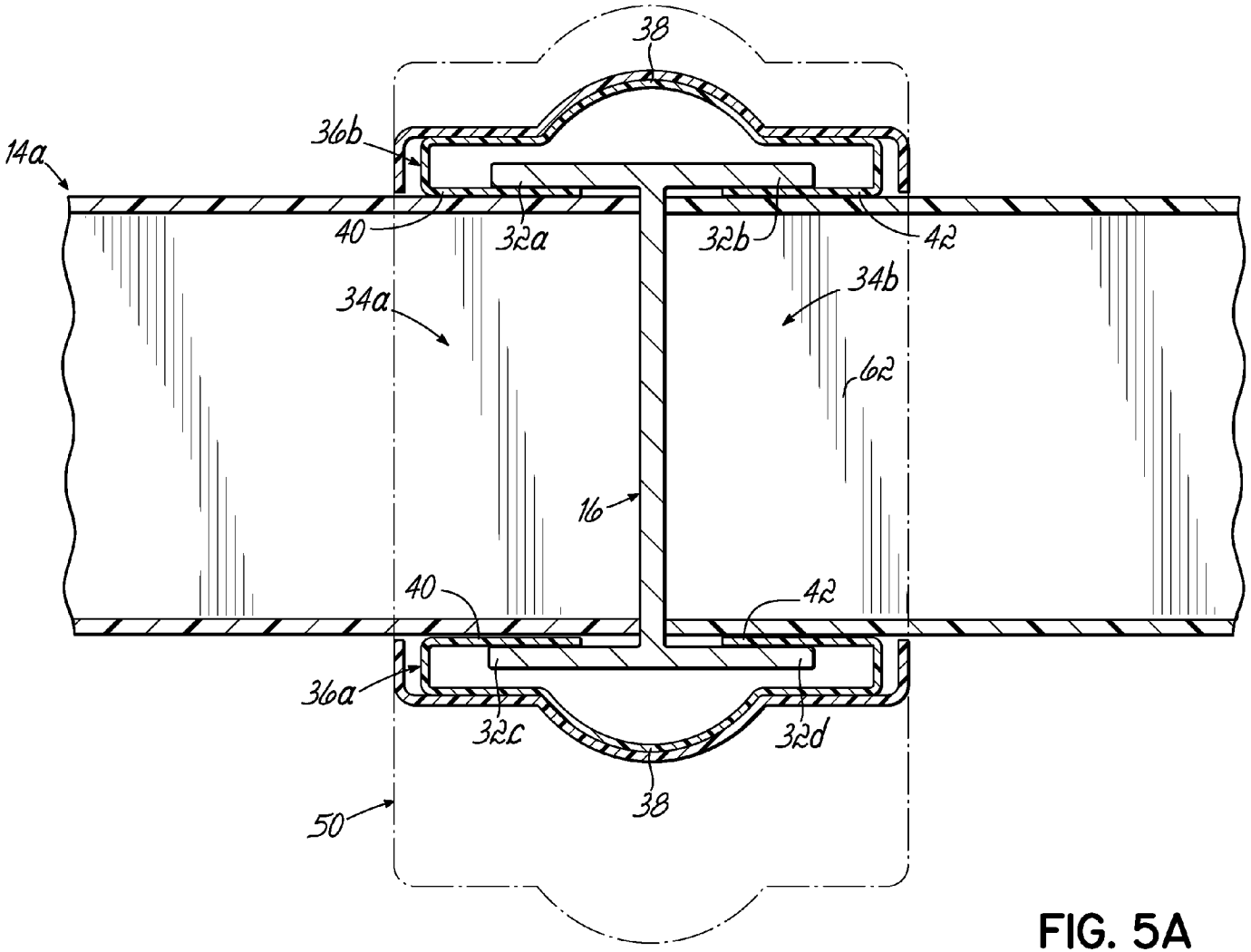
FIG. 5A is a partial cross-sectional view similar to FIG. 5, depicting another exemplary sound barrier.

FIG. 5A depicts another exemplary embodiment of a sound barrier 10*a* wherein wall sections 14*a* have a depth that occupies substantially the entire space between the flanges 32*a*, 32*b*, 32*c*, 32*d* of a post 16. In such embodiments, it will be appreciated that the dimensions of the wall sections 14*a* may be such that the wall sections 14*a* are securely held within the channels 34*a*, 34*b* of the posts 16 without the need for additional fasteners, brackets, or other structure.

Figure 7:
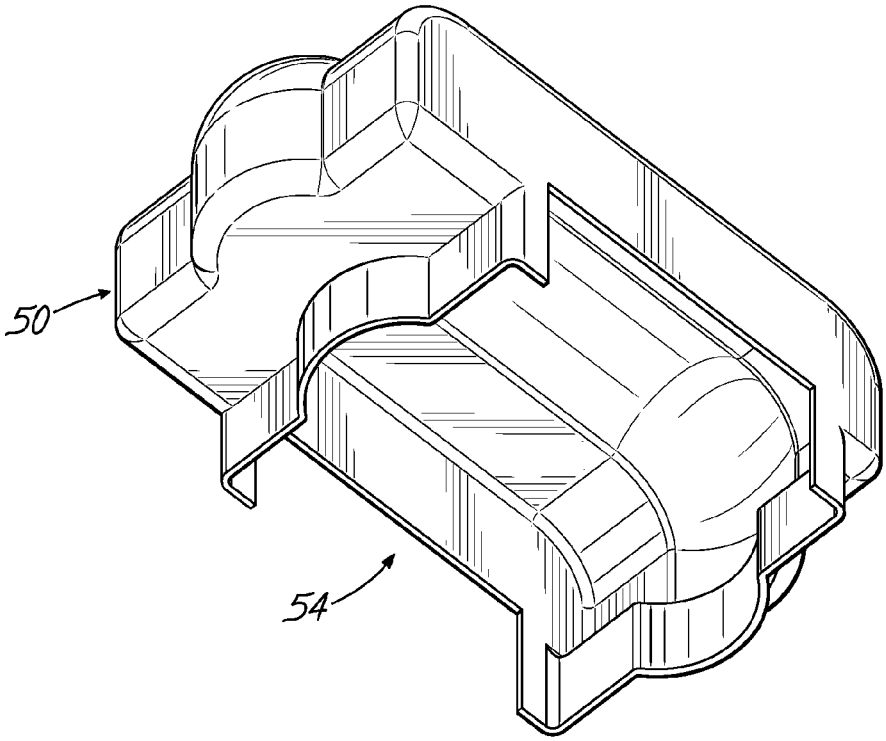
FIG. 7 is a bottom perspective view of an exemplary post cap of the sound barrier of FIG. 3.
Figure 8:
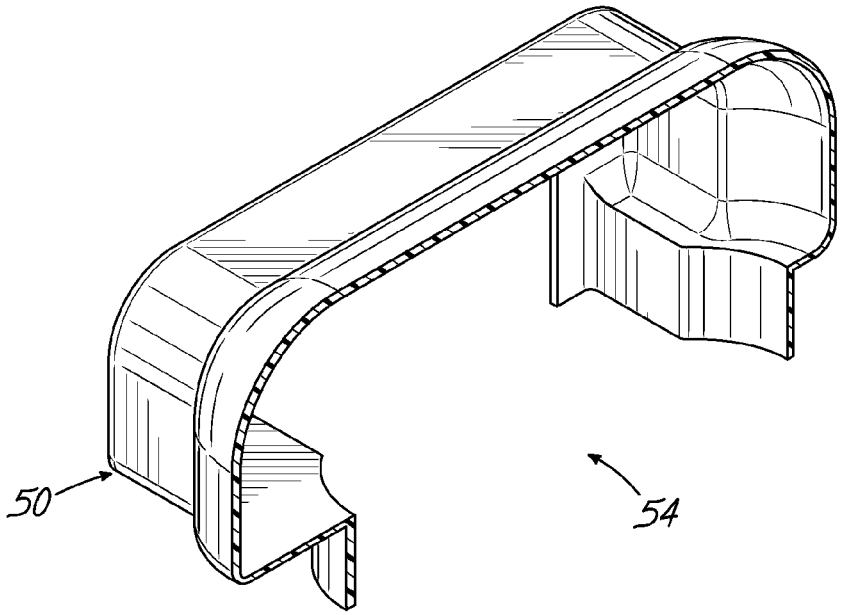
FIG. 8 is a cut-away view of the post cap of FIG. 7.

FIGS. 7 and 8 show detail of the post cap 50 shown and described above for use with the exemplary sound barrier 10.

In use, an exemplary method of making a sound barrier 10 having a plurality of spaced-apart posts 16 and at least one wall section 14 disposed between adjacent ones of the posts 16 may include securing at least one post cover 36*a*, 36*b* on an outer surface of at least one of the posts 16 and arranging at least one wall section 14 between the adjacent, spaced-apart posts 16. When it is desired to repair or replace an existing sound barrier, the method may further include removing at least one existing wall section from between the adjacent posts 16 for replacement with a different or refurbished wall section. The method may further include placing at least one post cap 50 over an upper, free end of at least one of the posts 16 and/placing at least one wall top cap 60 on an upper, free end of the at least one wall section 14.

While the present invention has been illustrated by the description of one or more exemplary embodiments, and while the embodiments have been described in considerable detail, they are not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A sound barrier, comprising:

a plurality of vertically extending posts, each post having at least one channel for receiving a distal end portion of a wall section therein such that said wall section is retained between adjacent, spaced posts;

wherein each post has a generally I-shaped cross section defined by a central structural web and spaced apart pairs of flanges extending generally perpendicular to said central web to define first and second oppositely disposed channels along said post;

at least one elongate post cover coupled with one of said plurality of posts and disposed over an outer surface thereof;

at least one wall section received in said channel of at least one of said plurality of posts; and at least one bracket coupled to said central web of at least one of said posts and cooperating with at least one of said flanges to define a space for receiving said wall section therebetween, said bracket including a first leg extending along said wall section, and a second leg extending along said central web.

2. The sound barrier of claim 1, wherein each post cover comprises a central wall portion, and first and second lip portions disposed on opposite ends of said central wall portion.

3. The sound barrier of claim 2, wherein:

each said lip portion of said post cover is received over at least a portion of one of said flanges of said post such that said post cover is retained on said post.

4. The sound barrier of claim 1, further comprising:

a post cap having an open end;

said post cap received on an upper, free end of one of said plurality of posts with said free end of said post extending within said open end of said post cap.

5. The sound barrier of claim 4, wherein at least a portion of said post cover is received within said open end of said post cap.

6. The sound barrier of claim 4, further comprising:

a wall top cap received on an upper free end of at least one wall section;

wherein at least one of said post cover, said post cap, said wall section, or said wall top cap comprises glass-reinforced polymeric material.

7. The sound barrier of claim 6, wherein each of said post cover, said post cap, said wall section, and said wall top cap comprises glass-reinforced polymeric material.

8. The sound barrier of claim 1, further comprising:

a wall top cap received on an upper free end of at least one wall section.

9. The sound barrier of claim 1, further comprising:

at least one fastener extending through said central web of said at least one post and coupling said at least one bracket to said post.

* * * * *